US009927194B2

(12) United States Patent
Muska

(10) Patent No.: US 9,927,194 B2
(45) Date of Patent: Mar. 27, 2018

(54) ROTARY AMMUNITION MAGAZINE AND FOLLOWER

(71) Applicant: Smith & Wesson Corp., Springfield, MA (US)

(72) Inventor: Simon M. Muska, Enfield, CT (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/200,027

(22) Filed: Jul. 1, 2016

(65) Prior Publication Data

US 2018/0003454 A1 Jan. 4, 2018

(51) Int. Cl.
*F41A 9/70* (2006.01)
*F41A 9/73* (2006.01)

(52) U.S. Cl.
CPC .. *F41A 9/73* (2013.01); *F41A 9/70* (2013.01)

(58) Field of Classification Search
CPC ..... F41A 9/73; F41A 9/70; F41A 9/74; F41A 9/77; F41A 9/65; F41A 9/64; F41A 9/75
USPC ..... 42/15, 49.01, 16, 17, 50, 19; 89/132, 89/33.02, 139, 197
See application file for complete search history.

(56) References Cited

U.S. PATENT DOCUMENTS 483,229 A * 9/1892 Lindner ..... F41A 9/73 42/19
608,023 A * 7/1898 Blake ..... F41A 9/73 124/48
696,118 A * 3/1902 Thorsen ..... F41A 19/45 42/16
1,696,537 A * 12/1928 Kewish ..... F41A 9/26 42/106
2,341,869 A 2/1944 Johnson, Jr.
3,239,959 A 3/1966 Sefried
3,562,944 A * 2/1971 Wagner K et al. ..... F41A 17/38 42/50
3,745,687 A * 7/1973 Koon, Jr. ..... F41A 9/26 42/19
4,079,535 A 3/1978 Elbe et al.
4,314,419 A 2/1982 Koon, Jr.
4,332,097 A * 6/1982 Taylor, Jr. ..... F41A 9/73 42/50
4,453,329 A * 6/1984 Brint ..... F41A 9/02 42/15
4,487,103 A 12/1984 Atchisson
4,658,700 A 4/1987 Sullivan
5,014,456 A 5/1991 Kurtz et al.
(Continued)

FOREIGN PATENT DOCUMENTS

AT 226114 B 2/1963
AT 254744 B 6/1967
GB 190600177 A 4/1906

*Primary Examiner* — John Cooper
(74) *Attorney, Agent, or Firm* — John A. Chionchio, Esquire; Ballard Spahr LLP

(57) ABSTRACT

A rotary ammunition magazine for a rifle has a follower that is spring biased and rotates about an axis to move cartridges for feeding to the rifle's chamber. The follower has a surface portion which engages the last cartridge in the stack. The surface portion has one or more characteristics including a transverse orientation angle, a longitudinal orientation angle and an arcuate shape which determine the direction of the force vector and the lengthwise load distribution on the cartridge.

14 Claims, 5 Drawing Sheets

(56) References Cited

U.S. PATENT DOCUMENTS

| | | | | |
|---|---|---|---|---|
| 6,502,495 | B1 * | 1/2003 | Beary | F41A 9/73 89/33.17 |
| 7,698,844 | B2 | 4/2010 | Gruber et al. | |
| 8,069,601 | B1 | 12/2011 | Fitzpatrick et al. | |
| 8,156,675 | B2 * | 4/2012 | Heath | F41A 9/65 42/17 |
| 8,448,364 | B2 | 5/2013 | Davidson | |
| 8,484,875 | B2 | 7/2013 | Heath | |
| 8,745,912 | B2 | 6/2014 | Heath | |
| 9,228,788 | B1 * | 1/2016 | Simon | F41A 9/70 |
| 9,523,546 | B1 * | 12/2016 | Harding | F41A 9/71 |
| 2012/0117840 | A1 * | 5/2012 | Chewning | F41A 9/70 42/49.01 |
| 2014/0250752 | A1 | 9/2014 | Heath | |
| 2015/0121736 | A1 | 5/2015 | Faifer | |
| 2016/0290749 | A1 * | 10/2016 | McCormick | F41A 9/66 |

* cited by examiner

ROTARY AMMUNITION MAGAZINE AND FOLLOWER

FIELD OF THE INVENTION

This invention relates to magazines for firearms.

BACKGROUND

It is desirable to decrease the malfunction rate of firearms, for example, bolt action rifles fed ammunition from rotary magazines. Some malfunctions find their cause in the characteristics of the magazine. For example, some prior art magazines suffer weak cartridge stack recovery. Weak cartridge stack recovery can cause bolt overrides, concomitant failure to feed, as well as permit excessive inertial movement of cartridges during recoil impulse. Weak cartridge stack recovery is attributable to a number of factors including cumulative friction between cartridges and high contact stress between cartridges due to single point contact between cartridges when subjected to force from a spring-biased follower. Unfavorable reaction force vectors between the follower paddle and the contacting cartridge (particularly in the fully loaded condition) are believed to be a particularly pernicious source of problems, as shown in FIG. 1 and described below.

An example prior art magazine 11 is shown in FIG. 1. Tests indicate that sources of firearm malfunction include the top cartridge 13*a* not being biased by the follower 15 sufficiently against the magazine lips 17, thereby allowing the cartridge to be forced back down into the magazine in response to inertial forces when subjected to recoil impulse. Some cartridges become trapped within the magazine as a result and are prevented from engaging the feed lips. Trapped cartridges are out of position for feeding upon cycling of the bolt and may cause a malfunction. Another malfunction is caused by the base or head of the top cartridge 13*a* slipping down the follower 15 away from the magazine lips 17. Even relatively small slippage may allow the bolt to override the top cartridge and not feed properly. These malfunctions are believed rooted in large part in the engagement between the follower and the last cartridge 13*b*, where it is observed that the force vector 19 between the follower 15 and the last cartridge 13*b* is normal to the contacting surface of the follower and thus not in the most advantageous direction to urge the cartridges into engagement with the magazine lips 17. This disadvantageous orientation of the contact vector is believed due to the fact that the prior art follower is flat along the length of the cartridge and thus does not account for the orientation of the last cartridge 13*b* due to the cartridge's tapered shape, or the change in cartridge angle relative to the follower as cartridges are removed from the magazine. There is an opportunity to improve the reliability of firearms, particularly bolt action rifles, by improving the characteristics of the ammunition magazine.

SUMMARY

The invention concerns a follower for advancing cartridges in an ammunition magazine. In one example embodiment the follower comprises a plate having a surface positionable within the magazine facing one of the cartridges. The plate has at least one edge oriented parallel to an axis of rotation of the plate. The surface comprises a surface portion engageable with the one cartridge. The surface portion is angularly oriented relatively to the plate at a transverse orientation angle measured about the axis of rotation. In one example embodiment the surface portion is arcuate and subtends an angle measured about an axis of curvature oriented transversely to the axis of rotation. In another example the surface portion is angularly oriented relatively to the plate at a longitudinal orientation angle measured about an axis oriented transversely to the axis of rotation.

By way of example, the follower further comprises a bearing mounted on the at least one edge. In a specific example the bearing comprises at least one lug attached to the at least one edge. The at least one lug defines a bore coaxially aligned with the axis of rotation of the plate. In another example the bearing comprises first and second lugs attached to the at least one edge. The first and second lugs define respective first and second bores coaxially aligned with the axis of rotation of the plate.

Another example follower for advancing cartridges in an ammunition magazine comprises a plate having a surface positionable within the magazine facing one of the cartridges. The plate has at least one edge oriented parallel to an axis of rotation of the plate. The surface comprises an arcuate surface portion engageable with the one cartridge and has a curvature which subtends an angle measured about an axis of curvature oriented transversely to the axis of rotation. By way of example the surface portion is angularly oriented at a transverse orientation angle measured about the axis of rotation. In another example the surface portion is angularly oriented at a longitudinal orientation angle measured about an axis oriented transversely to the axis of rotation.

An example follower embodiment further comprises a bearing mounted on the at least one edge. In a particular example embodiment the bearing comprises at least one lug attached to the at least one edge. The at least one lug defining a bore coaxially aligned with the axis of rotation of the plate. In another example embodiment the bearing comprises first and second lugs attached to the at least one edge. The first and second lugs define respective first and second bores coaxially aligned with the axis of rotation of the plate.

Another example follower for advancing cartridges in an ammunition magazine comprises a plate having a surface positionable within the magazine facing one of the cartridges. The plate has at least one edge oriented parallel to an axis of rotation of the plate. The surface comprises a surface portion engageable with the one cartridge. The surface portion is angularly oriented relatively to the plate at a longitudinal orientation angle measured about an axis oriented transversely to the axis of rotation. By way of further example the surface portion is angularly oriented at a transverse orientation angle measured about the axis of rotation. In an additional example the surface portion has a curvature which subtends an angle measured about an axis of curvature oriented transversely to the axis of rotation.

In an example embodiment the follower comprises a bearing mounted on the at least one edge. In a particular example the bearing comprises at least one lug attached to the at least one edge. The at least one lug defines a bore coaxially aligned with the axis of rotation of the plate. In another example the bearing comprises first and second lugs attached to the at least one edge. The first and second lugs define respective first and second bores coaxially aligned with the axis of rotation of the plate.

The invention also encompasses a magazine for holding a plurality of ammunition cartridges. In one example embodiment the magazine comprises a plurality of sidewalls defining a space for receiving the cartridges. An elongate opening is defined between a first and a second of the sidewalls providing access to the space. A follower is mounted within the space. The follower is rotatable about an axis of rotation oriented parallel to the elongate opening for urging the cartridges toward the opening. In one example embodiment the follower comprises a plate having a surface positioned facing one of the cartridges. The plate has at least one edge oriented parallel to the axis of rotation. The surface comprises a surface portion engageable with the one cartridge. The surface portion being angularly oriented relatively to the plate at a transverse orientation angle measured about the axis of rotation. A spring biases the plate for rotation about the axis of rotation.

In one example the surface portion is arcuate and subtends an angle measured about an axis of curvature oriented transversely to the axis of rotation. In another example the surface portion is angularly oriented relatively to the plate at a longitudinal orientation angle measured about an axis oriented transversely to the axis of rotation. In a further example the surface portion is angularly oriented relatively to the plate at a longitudinal orientation angle measured about an axis oriented transversely to the axis of rotation.

An example magazine further comprises a shaft mounted within the space. The shaft is coaxial with the axis of rotation. The plate is mounted on the shaft. By way of example a bearing is mounted on the at least one edge. The bearing engages the shaft. In an example embodiment the bearing comprises at least one lug mounted on the at least one edge. The at least one lug defines a bore receiving the shaft. In another example the bearing comprises first and second lugs attached to the at least one edge. The first and second lugs define respective first and second bores receiving the shaft. In an example magazine one end of the shaft is supported on a third one of the sidewalls and an opposite end of the shaft is supported on a fourth one of the sidewalls. The third and fourth sidewalls are at opposite ends of the magazine. Further by way of example the spring comprises a coil spring acting between the plate and one of the sidewalls.

Another example embodiment of magazine for holding a plurality of ammunition cartridges comprises a plurality of sidewalls defining a space for receiving the cartridges. An elongate opening defined between a first and a second of the sidewalls provides access to the space. A follower is mounted within the space. The follower is rotatable about an axis of rotation oriented parallel to the elongate opening for urging the cartridges toward the opening. In an example embodiment the follower comprises a plate having a surface positioned facing one of the cartridges. The plate has at least one edge oriented parallel to the axis of rotation. The surface comprises an arcuate surface portion engageable with the one cartridge and having a curvature which subtends an angle measured about an axis of curvature oriented transversely to the axis of rotation. A spring biases the plate for rotation about the axis of rotation.

Further by way of example the surface portion is angularly oriented at a transverse orientation angle measured about the axis of rotation. In another example the surface portion is angularly oriented at a longitudinal orientation angle measured about an axis oriented transversely to the axis of rotation.

In an example embodiment the magazine further comprises a shaft mounted within the space. The shaft is coaxial with the axis of rotation. The plate is mounted on the shaft. By way of example a bearing is mounted on the at least one edge. The bearing engages the shaft. In an example embodiment the bearing comprises at least one lug mounted on the at least one edge. The at least one lug defines a bore receiving the shaft. In another example the bearing comprises first and second lugs attached to the at least one edge. The first and second lugs define respective first and second bores receiving the shaft.

In an example magazine one end of the shaft is supported on a third one of the sidewalls and an opposite end of the shaft is supported on a fourth one of the sidewalls. The third and fourth sidewalls are at opposite ends of the magazine. Further by way of example the spring comprises a coil spring acting between the plate and one of the sidewalls.

Another example embodiment of a magazine for holding a plurality of ammunition cartridges, the magazine comprises a plurality of sidewalls defining a space for receiving the cartridges. An elongate opening is defined between a first and a second of the sidewalls providing access to the space. A follower is mounted within the space. The follower is rotatable about an axis of rotation oriented parallel to the elongate opening for urging the cartridges toward the opening. In an example embodiment the follower comprises a plate having a surface positioned facing one of the cartridges. The plate has at least one edge oriented parallel to the axis of rotation. The surface comprises a surface portion engageable with the one cartridge. The surface portion is angularly oriented at a longitudinal orientation angle measured about an axis oriented transversely to the axis of rotation. A spring biases the plate for rotation about the axis of rotation.

By way of example the surface portion is angularly oriented at a transverse orientation angle measured about the axis of rotation. In an example embodiment the surface portion has a curvature which subtends an angle measured about an axis of curvature oriented transversely to the axis of rotation. An example magazine further comprises a shaft mounted within the space. The shaft is coaxial with the axis of rotation. The plate is mounted on the shaft. In an example embodiment a bearing is mounted on the at least one edge. The bearing engages the shaft. In a particular example embodiment the bearing comprises at least one lug mounted on the at least one edge, the at least one lug defining a bore receiving the shaft. In another example embodiment the bearing comprises first and second lugs attached to the at least one edge. The first and second lugs define respective first and second bores receiving the shaft. In an example embodiment one end of the shaft is supported on a third one of the sidewalls and an opposite end of the shaft is supported on a fourth one of the sidewalls. By way of example the third and fourth sidewalls are at opposite ends of the magazine. In an example embodiment the spring comprises a coil spring acting between the plate and one of the sidewalls.

DETAILED DESCRIPTION

Figure 2:
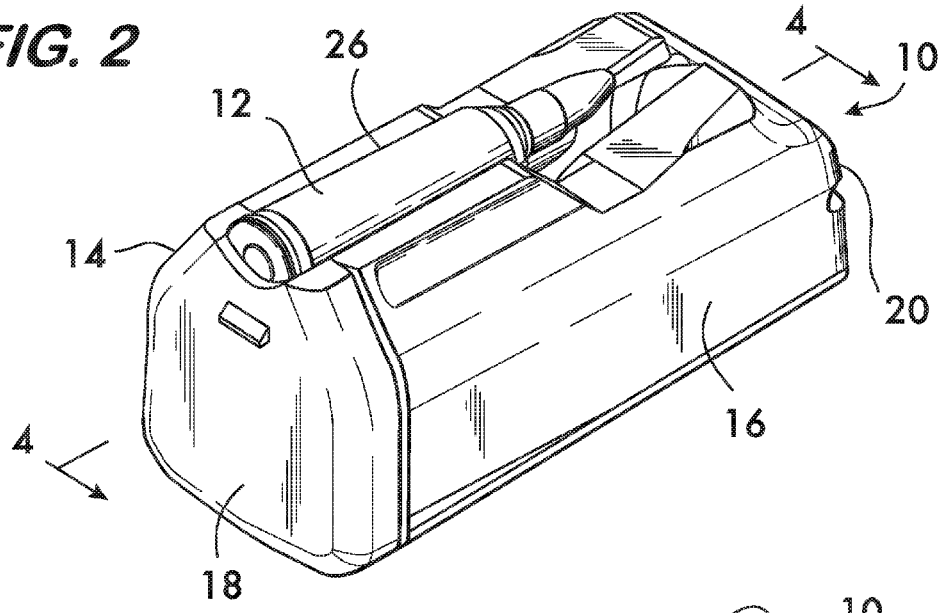
FIG. 2 is an isometric view of an example rotary ammunition magazine according to the invention.
Figure 3:
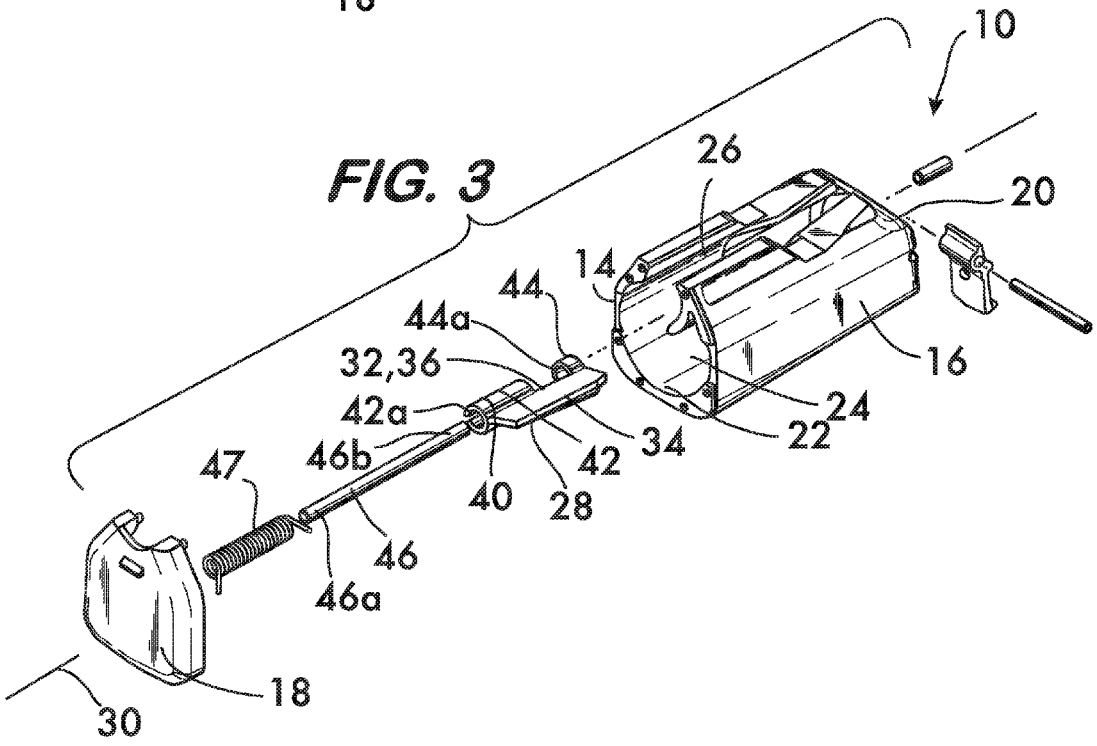
FIG. 3 is an exploded isometric view of the example rotary ammunition magazine shown in FIG. 2.
Figure 4:
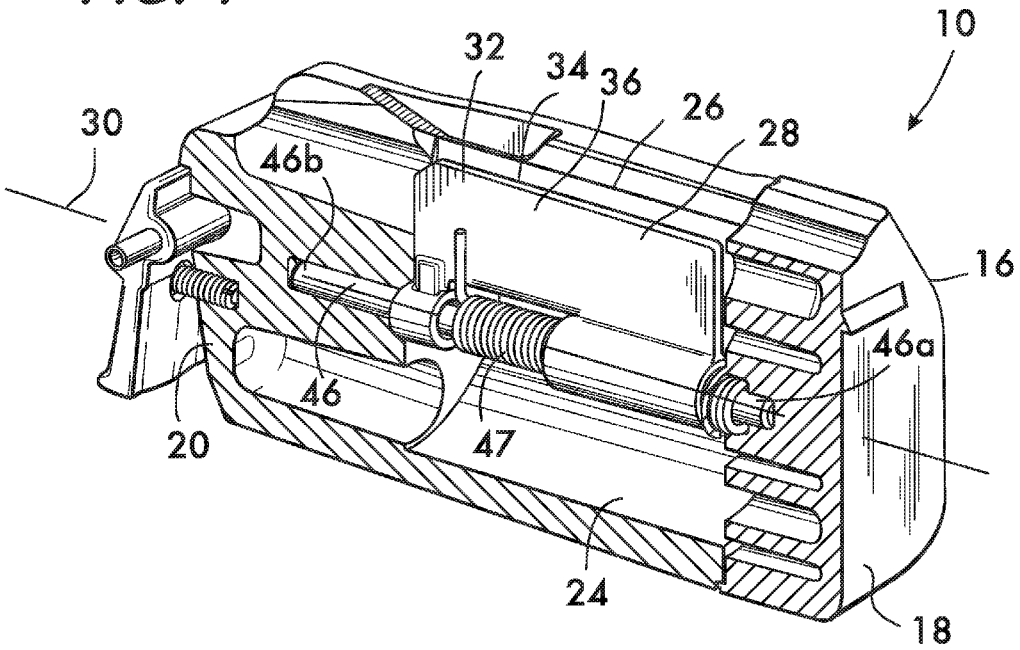
FIG. 4 is a longitudinal isometric sectional view taken at line 4-4 of FIG. 2.
Figure 8:
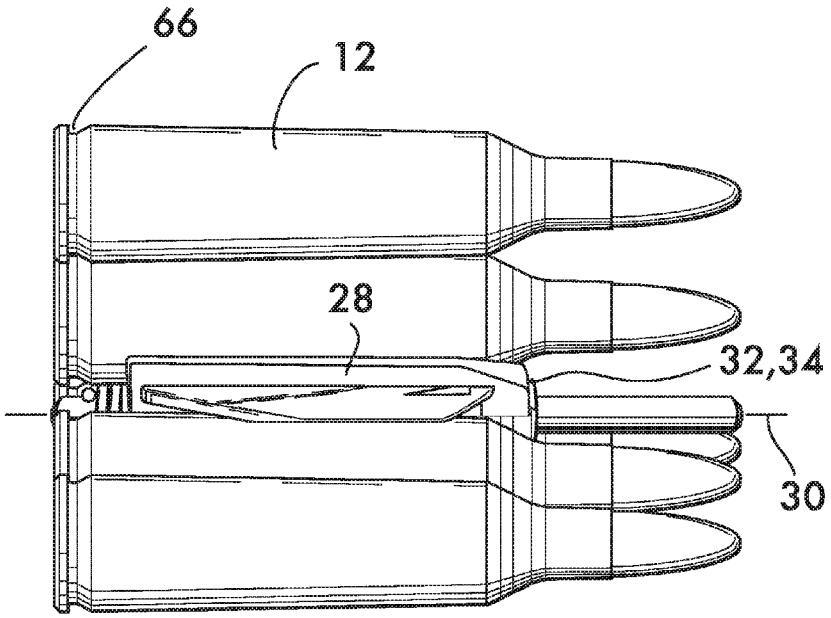
FIG. 8 is an elevational view of the follower shown in FIG. 5 illustrating engagement between the follower and ammunition cartridges.

FIGS. 2 and 3 show an example magazine 10 according to the invention for holding a plurality of ammunition cartridges 12. Magazine 10 comprises a plurality of sidewalls 14, 16, 18, 20 and 22 defining a space 24 for receiving the cartridges 12. An elongate opening 26 is defined between a first sidewall 14 and a second sidewall 16, the opening providing access to space 24 permitting loading and removal of the cartridges 12 to and from the magazine 10. As shown in FIGS. 3 and 4, a follower 28 is mounted within the space 24. Follower 28 is rotatable about an axis of rotation 30 oriented parallel to the elongate opening 26. In the example shown in FIGS. 4 and 5, the follower 28 comprises a plate 32 having first and second side surfaces 34 and 36 oppositely disposed. Side surface 34 is positioned within space 24 of magazine 10 facing the cartridges 12 (see FIGS. 8 and 9). Plate 32 further has an edge 38 oriented parallel to the axis of rotation 30 (see FIG. 5).

Figure 5:
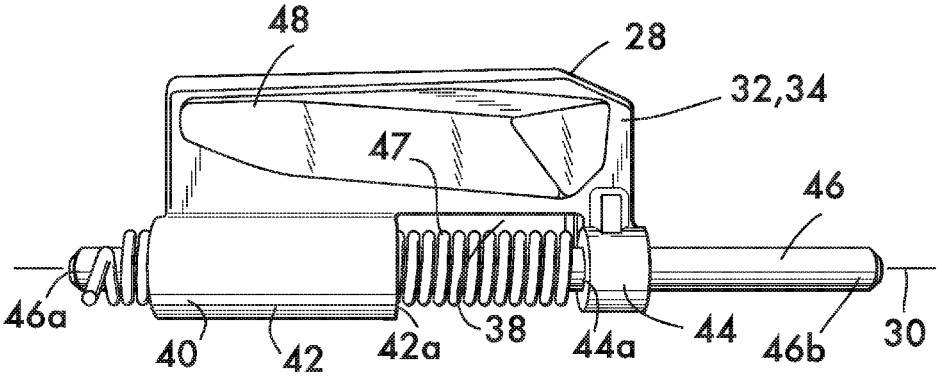
FIG. 5 is an elevational view of an example follower for the rotary ammunition magazine shown in FIG. 2.

Mounting of the follower 28 within space 24 is effected via one or more bearings 40 mounted on edge 38. In this example embodiment the bearings 40 comprise first and second lugs 42 and 44. Each lug 42, 44 defines a respective bore 42*a*, 44*a* which receives a shaft 46, as shown in FIGS. 4 and 5. Shaft 46 is coaxial with the axis of rotation 30. One end, 46*a* of shaft 46, is supported on the third sidewall 18, and the opposite end, 46*b* of shaft 46, is supported on the fourth sidewall 20. The third and fourth sidewalls comprise opposite ends of the magazine 10. As shown in FIG. 4, a coil spring 47 acts between the plate 32 and the sidewall 18 to bias the plate in rotation about the axis of rotation 30 to urge the cartridges toward the opening 26.

Figure 1:
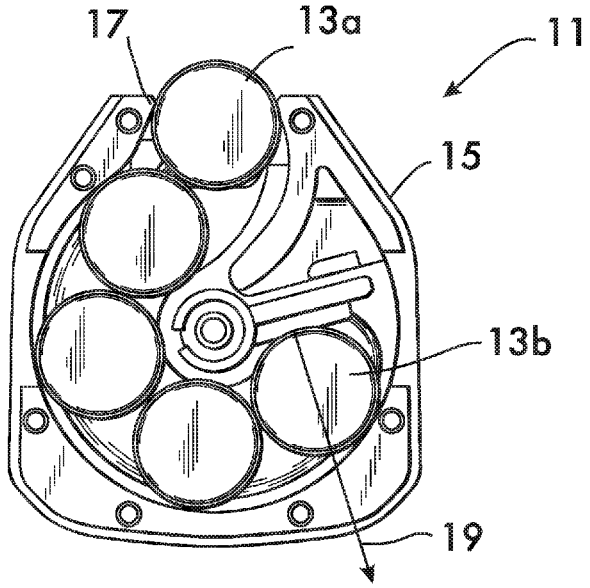
FIG. 1 PRIOR ART
FIG. 1 is a cross sectional view through an example prior art rotary ammunition magazine.
Figure 9:
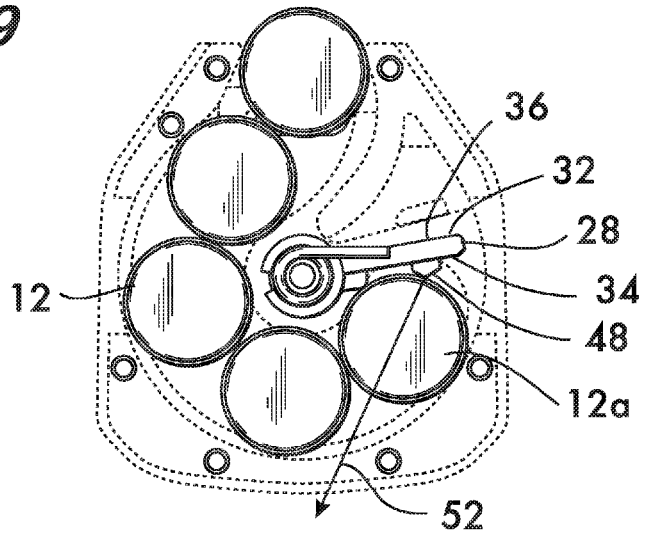
FIG. 9 is a sectional end view of the follower shown in FIG. 5 illustrating engagement between the follower and ammunition cartridges, the magazine sidewalls being shown in broken line.

As shown in FIG. 5, surface 34 of plate 32 comprises a surface portion 48 engageable with the last cartridge 12*a* in the stack of cartridges 12 (see also FIG. 9). Surface portion 48 has various characteristics, used either alone or in combination, which are expected to effectively address the potential for weak cartridge stack recovery in magazines according to the invention.

Figure 6:
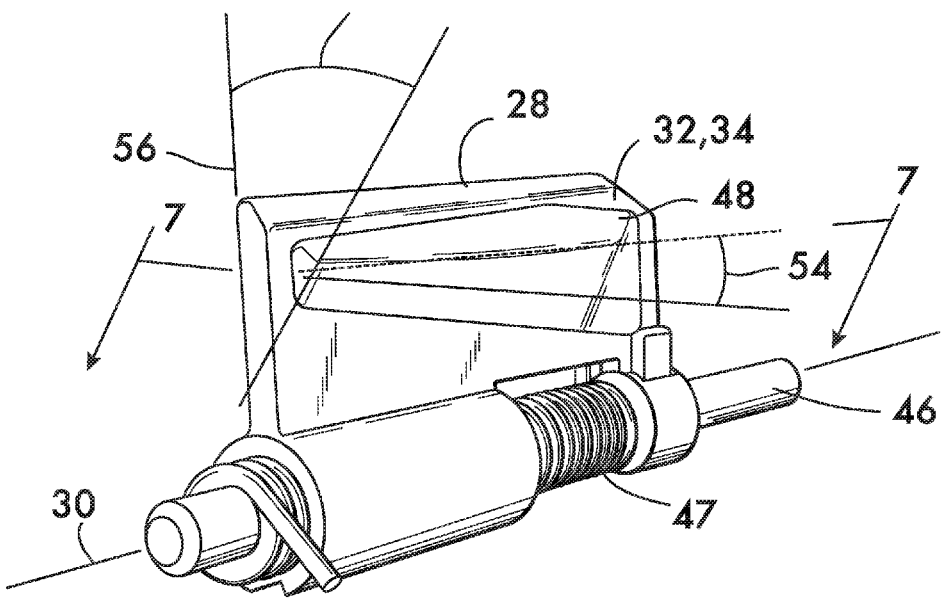
FIG. 6 is an isometric view of the follower shown in FIG. 5
Figure 7:
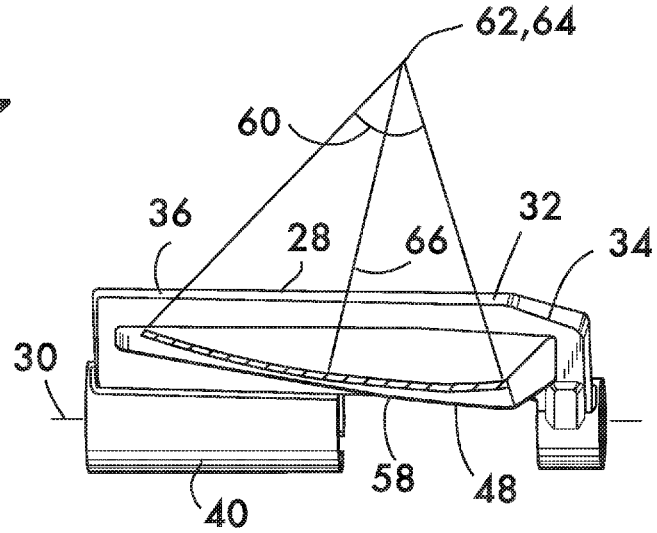
FIG. 7 is a cross sectional view of the follower taken at line 7-7 of FIG. 6.

One characteristic of surface portion 48 is its transverse orientation angle 50, illustrated in FIG. 6. Transverse orientation angle 50 is measured with respect to plate 32 about the axis of rotation 30. For practical designs the transverse orientation angle 50 ranges from about 20° to about 40° depending on the size of the cartridge. A transverse orientation angle 50 of about 30° is expected to be advantageous. The transverse orientation angle is one factor responsible for determining the direction of the force vector 52 on cartridge 12*a* as shown in FIG. 9. Another characteristic of surface portion 48 is its longitudinal orientation angle 54 which is measured about an axis 56 oriented transversely to the axis of rotation 30. For practical designs the longitudinal orientation angle 54 ranges from about 2° to about 7° and helps accommodate the taper of the cartridge 12*a* to the follower 28. A longitudinal orientation angle 54 of about 5° is expected to be advantageous. Another characteristic of surface portion 48 is its arcuate shape 58, as shown in the cross section of FIG. 7. Surface portion 48 subtends an angle 60 measured about an axis of curvature 62 oriented transversely to the axis of rotation 30 and positioned at the center of curvature 64 of the arcuate surface portion 48. For a practical design the radius of curvature 66 ranges from about 3 inches to about 10 inches. A radius of curvature of about 6 inches is expected to be advantageous.

The transverse orientation angle 50, the longitudinal orientation angle 54 and the arcuate cross sectional shape 58 of surface portion 48 cooperate to direct the force vector 52 more in the direction of motion of the cartridges 12 (see FIG. 9) thus applying more useful force for a specified spring force to move the cartridges toward the magazine feed lips. The characteristics are also designed to apply more force to the head (back end) 68 of cartridge 12*a* (see FIG. 8) to mitigate bolt override and its associated failures even as cartridges 12 are removed from the stack. The characteristics of surface portion 48 are furthermore expected to improve cartridge stack recovery for all magazine capacity configurations including displacement of cartridges due to bolt cycling.

Ammunition magazines using followers according to the invention are expected to reduce feeding malfunctions, especially in bolt action rifles.

What is claimed is:

1. A follower for advancing cartridges in an ammunition magazine, said follower comprising:

a plate having a surface positionable within said magazine facing one of said cartridges, said plate having an axis of rotation oriented parallel to said one cartridge;

a bearing mounted on said plate, said bearing comprising at least one lug, said at least one lug defining a bore coaxially aligned with said axis of rotation of said plate;

said surface comprising a surface portion projecting outwardly from said plate, said surface portion being engageable with said one cartridge, said surface portion being angularly oriented relatively to said plate at a transverse orientation angle measured about said axis of rotation.

2. A follower according to claim 1, wherein said surface portion is arcuate and subtends an angle measured about an axis of curvature oriented transversely to said axis of rotation.

3. The follower according to claim 2, wherein said surface portion is angularly oriented relatively to said plate at a longitudinal orientation angle measured about an axis oriented transversely to said axis of rotation.

4. The follower according to claim 1, wherein said surface portion is angularly oriented relatively to said plate at a longitudinal orientation angle measured about an axis oriented transversely to said axis of rotation.

5. The follower according to claim 1, wherein said bearing comprises first and second lugs, said first and second lugs defining respective first and second bores coaxially aligned with said axis of rotation of said plate.

6. A magazine for holding a plurality of ammunition cartridges, said magazine comprising:

a plurality of sidewalls defining a space for receiving said cartridges;

an elongate opening defined between a first and a second of said sidewalls providing access to said space;

a follower mounted within said space, said follower being rotatable about an axis of rotation oriented parallel to said cartridges for urging said cartridges toward said opening, said follower comprising:

a plate having a surface positioned facing one of said cartridges;

a shaft mounted within said space, said shaft being coaxial with said axis of rotation, said plate being mounted on said shaft;

said surface comprising a surface portion projecting outwardly from said plate, said surface portion being engageable with said one cartridge, said surface portion being angularly oriented relatively to said plate at a transverse orientation angle measured about said axis of rotation a spring biasing said plate for rotation about said axis of rotation.

7. The magazine according to claim 6, wherein said surface portion is arcuate and subtends an angle measured about an axis of curvature oriented transversely to said axis of rotation.

8. The magazine according to claim 7, wherein said surface portion is angularly oriented relatively to said plate at a longitudinal orientation angle measured about an axis oriented transversely to said axis of rotation.

9. The magazine according to claim 6, wherein said surface portion is angularly oriented relatively to said plate at a longitudinal orientation angle measured about an axis oriented transversely to said axis of rotation.

10. The magazine according to claim 6, further comprising a bearing mounted on said plate, said bearing engaging said shaft.

11. The magazine according to claim 10, wherein said bearing comprises at least one lug mounted on said plate, said at least one lug defining a bore receiving said shaft.

12. The magazine according to claim 10, wherein said bearing comprises first and second lugs attached to said plate, said first and second lugs defining respective first and second bores receiving said shaft.

13. The magazine according to claim 6, wherein one end of said shaft is supported on a third one of said sidewalls and an opposite end of said shaft is supported on a fourth one of said sidewalls, said third and fourth sidewalls being at opposite ends of said magazine.

14. The magazine according to claim 6, wherein said spring comprises a coil spring acting between said plate and one of said sidewalls.

* * * * *